United States Patent [19]

Lindsay

[11] 4,188,173

[45] Feb. 12, 1980

[54] VERTICAL PUMP WITH FREE FLOATING CHECK VALVE

[75] Inventor: Malcolm Lindsay, O'Hara Township, Allegheny County, Pa.

[73] Assignee: The United States of America as represented by the Department of Energy, Washington, D.C.

[21] Appl. No.: 730,056

[22] Filed: Oct. 6, 1976

[51] Int. Cl.[2] ..... F04B 17/00

[52] U.S. Cl. ..... 417/424; 137/519.5

[58] Field of Search ..... 417/424; 415/53; 137/533.11, 533.13, 533.15, 519, 519.15

[56] References Cited

U.S. PATENT DOCUMENTS

| | | | |
|---|---|---|---|
| 1,882,314 | 10/1932 | Burt | 137/519.5 |
| 2,615,676 | 10/1952 | Neubauer | 137/519.5 |
| 2,745,725 | 5/1956 | Ward et al. | 137/519.5 |
| 2,829,719 | 4/1958 | Clark, Jr. | 137/519.5 |
| 3,059,667 | 10/1932 | Coceano | 137/533.13 |
| 3,367,362 | 2/1968 | Hoffman | 137/519.5 |
| 3,796,230 | 3/1974 | Meripol | 137/533.11 |
| 3,854,848 | 12/1974 | Laing | 417/424 |
| 3,910,714 | 10/1975 | Allen et al. | 415/53 R |
| 3,970,106 | 7/1976 | Harris | 137/533.11 |

FOREIGN PATENT DOCUMENTS

| | | | |
|---|---|---|---|
| 455016 | 3/1949 | Canada | 137/533.11 |

*Primary Examiner*—C. J. Husar

*Attorney, Agent, or Firm*—L. A. De Paul; Z. L. Dermer

[57] ABSTRACT

A vertical pump with a bottom discharge having a free floating check valve disposed in the outlet plenum thereof. The free floating check valve comprises a spherical member with a hemispherical cage-like member attached thereto which is capable of allowing forward or reverse flow under appropriate conditions while preventing reverse flow under inappropriate conditions.

3 Claims, 5 Drawing Figures

VERTICAL PUMP WITH FREE FLOATING CHECK VALVE

BACKGROUND OF THE INVENTION

This invention relates to vertical pumps and particularly to nuclear reactor coolant vertical pumps with check valves.

In nuclear steam supply systems well known in the art, a reactor vessel contains fuel assemblies with nuclear fuel therein which produce heat in a commonly understood fashion. A coolant, which in fast breeder reactors may be liquid sodium, is circulated through the reactor vessel in heat transfer relationship with the fuel assemblies therein transferring heat from the fuel assemblies to the coolant. The coolant may then be conducted by a piping network to a heat exchanger and back to the reactor vessel tracing a path that is generally referred to as a primary loop while the coolant flowing through such a primary loop is referred to as a primary coolant or primary fluid. While passing through the heat exchanger, the primary coolant transfers heat to a secondary coolant or fluid. The secondary coolant may then be conducted to a steam generator that produces steam in a manner well known to those skilled in the art. The path traced by such a secondary coolant is generally referred to as a secondary loop. In many commonly known nuclear steam supply systems, there are three primary loops disposed symmetrically with respect to the reactor vessel. In order to circulate the primary coolant through these loops a coolant pump is provided in each such primary loop to pump the primary coolant through each primary loop.

During reactor operation, the three coolant pumps simultaneously pump primary coolant into the reactor vessel where the three primary coolant streams intermingle and pass in heat transfer relationship with the fuel assemblies therein. From this common pool of primary coolant, the primary coolant exits the reactor vessel under pressure into the remainder of the three primary loops. While the three primary loops function cooperatively under normal reactor conditions, under abnormal conditions the interconnection of the primary loops may result in damage to the system.

One such abnormal condition that may result in damage to the system is the failure of one of the coolant pumps while the other coolant pumps remain operating. In this situation, the operating coolant pumps may cause primary coolant to be conducted through the primary loop of the non-operating pump in reverse direction of its normal flow thereby causing the non-operating coolant pump rotor to turn in the opposite direction for which it was designed. This reverse rotation of the rotor of the coolant pump can cause severe damage to the coolant pump as is well known in the art. Although prevention of reverse flow through the non-operating coolant pump when the other pumps are operating is important, it is not the only consideration. Another important consideration is that in the event that all pumps fail simultaneously such as in a plant power failure, the primary loop paths must remain open to allow natural circulation of the primary coolant through the primary loops to facilitate cooling of the reactor vessel core.

One device known to prevent reverse flow when one coolant pump fails and to allow natural circulation when all coolant pumps fail is a type of swing valve that is placed in the piping network. This type of valve consists of a substantially circular metal flap attached by a hinge arrangement to the inside of a horizontal segment of piping such that under reverse flow the metal flap pivots about the hinge into an acute angle with respect to the hinge thus blocking the flow path. However, when all coolant pumps are not operating, the metal flap hangs from the hinge in a substantially vertical attitude without contacting the side of the pipe opposite the hinge thereby allowing natural circulation through the primary loop by allowing coolant to flow between the metal flap and the side of the pipe opposite the hinge because the natural circulatory flow is not sufficient to force the metal flap into the acute angle necessary to block flow. While this device does solve some of the reverse flow problems, it creates additional problems in that the hinge-metal flap attachment creates a wearing surface and a surface susceptible to self-welding under high temperature coolants which thereby demand frequent maintenance attendance.

In addition to being capable of solving the flow problems, when the primary coolant is liquid sodium the device must be capable of being completely drained for inspection and removal because any remnant of liquid sodium in the device that may become exposed to oxygen will burn violently when so exposed to oxygen. Furthermore, the device must be able to withstand the severe thermal transients present in a nuclear steam supply system without substantially increasing the length of the primary loop or substantially increasing the cost of the system. While there are types of check valves known in the art that are capable of preventing reverse flow, they are not capable of totally solving the flow problems in nuclear reactor steam supply systems.

There are many check valves in the art that allow flow in both directions under appropriate conditions. These check valves generally consist of a float member having a first end manufactured to conform to the shape of the valve seat and having a second end formed into a winged configuration capable of spanning a valve opening, opposite the valve seat, for allowing flow through the valve opening and between the winged configuration. Under normal conditions, a fluid is allowed to flow through the valve by passing through the winged configuration; however, under certain pressure conditions the first end of the float member is forced against the valve seat thereby preventing flow through the valve. While these valves do perform necessary functions, they may not be of an appropriate configuration for purposes that require a specific configuration for optimum operational efficiency.

SUMMARY OF THE INVENTION

A vertical pump with a bottom discharge having a free floating check valve disposed in the discharge channel of the outlet plenum thereof. The free floating check valve comprises a spherical member attached to a hermispherical cage-like member. The discharge channel is constructed with an inlet and an outlet nozzle having a diameter smaller than the largest diameters of the spherical or cage-like members so as to contain them therein. During normal operation, the cage-like member rests on the outlet nozzle while supporting the spherical member such that the flow of fluid through the discharge channel enters through the inlet nozzle, flows around the spherical member, through the cage-like member, and out the outlet nozzle. However, when there is a strong reverse flow through the discharge channel, such as when the pump is not operating, the strong reverse flow causes the spherical member to rise upward and block the inlet nozzle thereby preventing such strong reverse flow from damaging the pump and other systems. Nevertheless, when such a reverse flow is not severe, the force of the reverse flow is not strong enough to lift the spherical member which, therefore, allows reverse flow in the pump under appropriate conditions.

It is an object of this invention to provide a vertical pump with a bottom discharge having a free floating check valve disposed in the outlet plenum thereof which is capable of preventing reverse flow under certain conditions while allowing reverse flow under other conditions.

It is a more particular object of this invention to provide a vertical nuclear reactor coolant pump with a bottom discharge having a free floating check valve disposed in the outlet plenum thereof which is capable of preventing reverse flow of a sodium coolant when the pump is not operating and other pumps in the system are operating while allowing a natural circulatory reverse or forward flow when all the pumps in the system are not operating.

BRIEF DESCRIPTION OF THE DRAWINGS

While the specification concludes with claims specifically pointing out and distinctly claiming the subject matter of the invention, it is believed the invention will be better understood from the following description taken in conjunction with the accompanying drawings, wherein:

DESCRIPTION OF THE PREFERRED EMBODIMENT

In order for nuclear reactor coolant pumps to be used effectively in reactor operations, it is necessary that they have the capability of allowing circulation of a coolant through them at certain flow rates while being able to prevent reverse flow through them at high flow rates. The invention herein disclosed provides those capabilities to such a pump.

Figure 1:
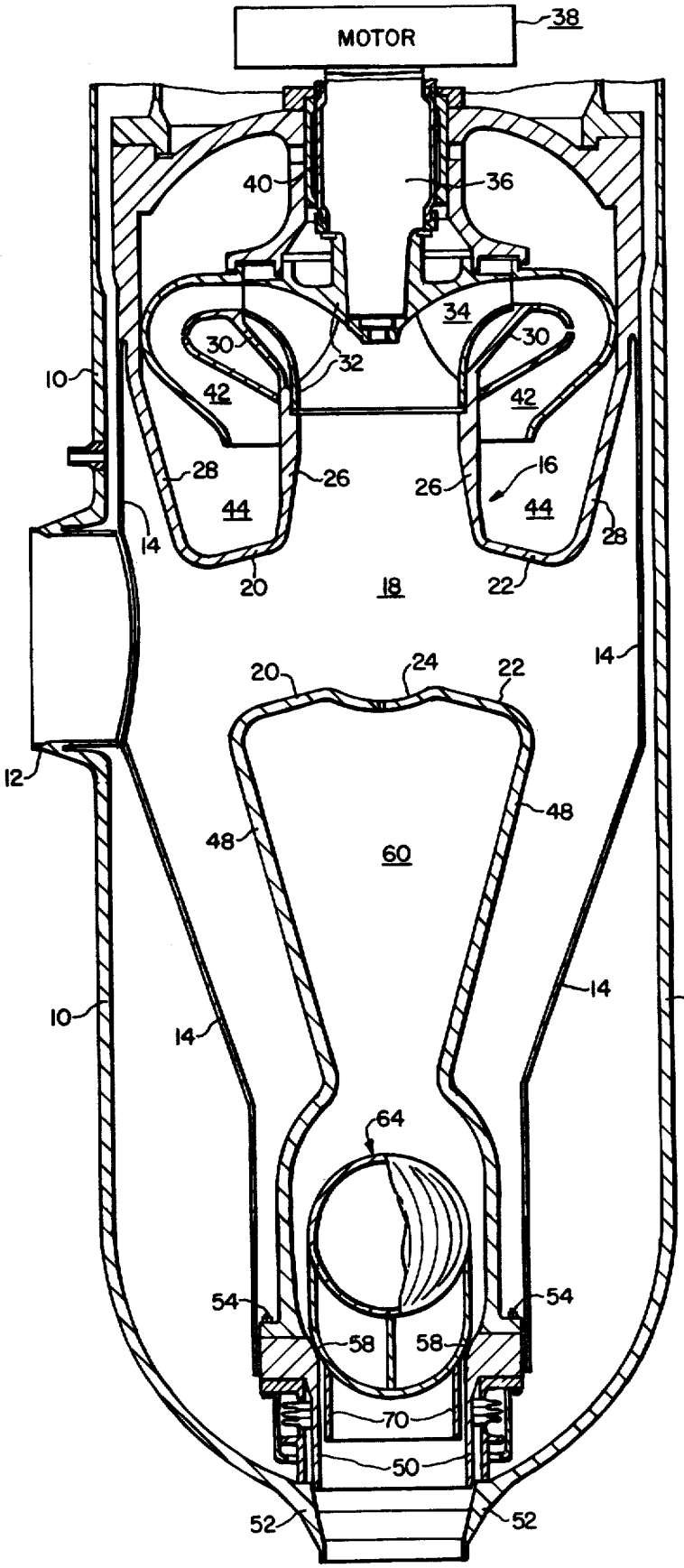
FIG. 1 is a partial cross-sectional view in elevation of a typical vertical pump with bottom discharge.

Referring to FIG. 1, a shell 10 encloses the internals of the coolant pump. Disposed on the lower portion of shell 10 is an inlet nozzle 12 that connects the coolant pump to the reactor vessel (not shown) by means of a piping network (not shown) in a manner well understood by those skilled in the art. Inlet nozzle 12 is in fluid communication with collector tank 14 that is disposed within the lower portion of shell 10. An inlet chamber 16 disposed within collector tank 14 defines an inlet plenum 18 therein. Inlet chamber 16 comprises a first inlet pipe section 20, a second inlet pipe section 22, a dished section 24, and a tapered section 26 all of which may be manufactured as one piece or attached together by means well known in the art such as welds. First inlet pipe section 20 and second inlet pipe section 22 which are disposed approximately 180 degrees apart form two pipe-like inlets into inlet plenum 18. Dished section 24 together with first inlet pipe section 20 and second inlet pipe section 22 define a substantially spherical bottom portion of inlet plenum 18 while tapered section 26 together with first inlet pipe section 20 and second inlet pipe section 22 define an outlet from inlet plenum 18. Inlet chamber 16 is supported at one end from collector tank 14 by means of an inlet flange 28 and is attached to seal ring 30 near the end of tapered section 26. Inlet chamber 16 serves to conduct the coolant that has entered inlet nozzle 12, from collector tank 14 into the pressurizing mechanism of the coolant pump.

Impeller 32 with vane 34 is mounted on rotor 36 in a manner well known in the art and disposed within the conical space defined by seal ring 30 and adjacent to and in fluid communication with inlet plenum 18. Rotor 36 is rotatably mounted within and is an integral part of motor 38, as is commonly understood, and is supported by bearing 40 so as to be capable of rotating under the driving force of motor 38. The rotation of rotor 36 causes impeller 32 and vane 34 to rotate with it thereby drawing coolant from inlet plenum 18. A diffuser 42 is disposed adjacent to impeller 32 in a manner so as to decrease the velocity of the coolant passing by impeller 32 while increasing the pressure thereof. The outside of diffuser 42 together with inlet flange 28 and the outside of inlet chamber 16 define a diffuser plenum 44 that is capable of collecting the coolant exiting diffuser 42.

Figure 2:
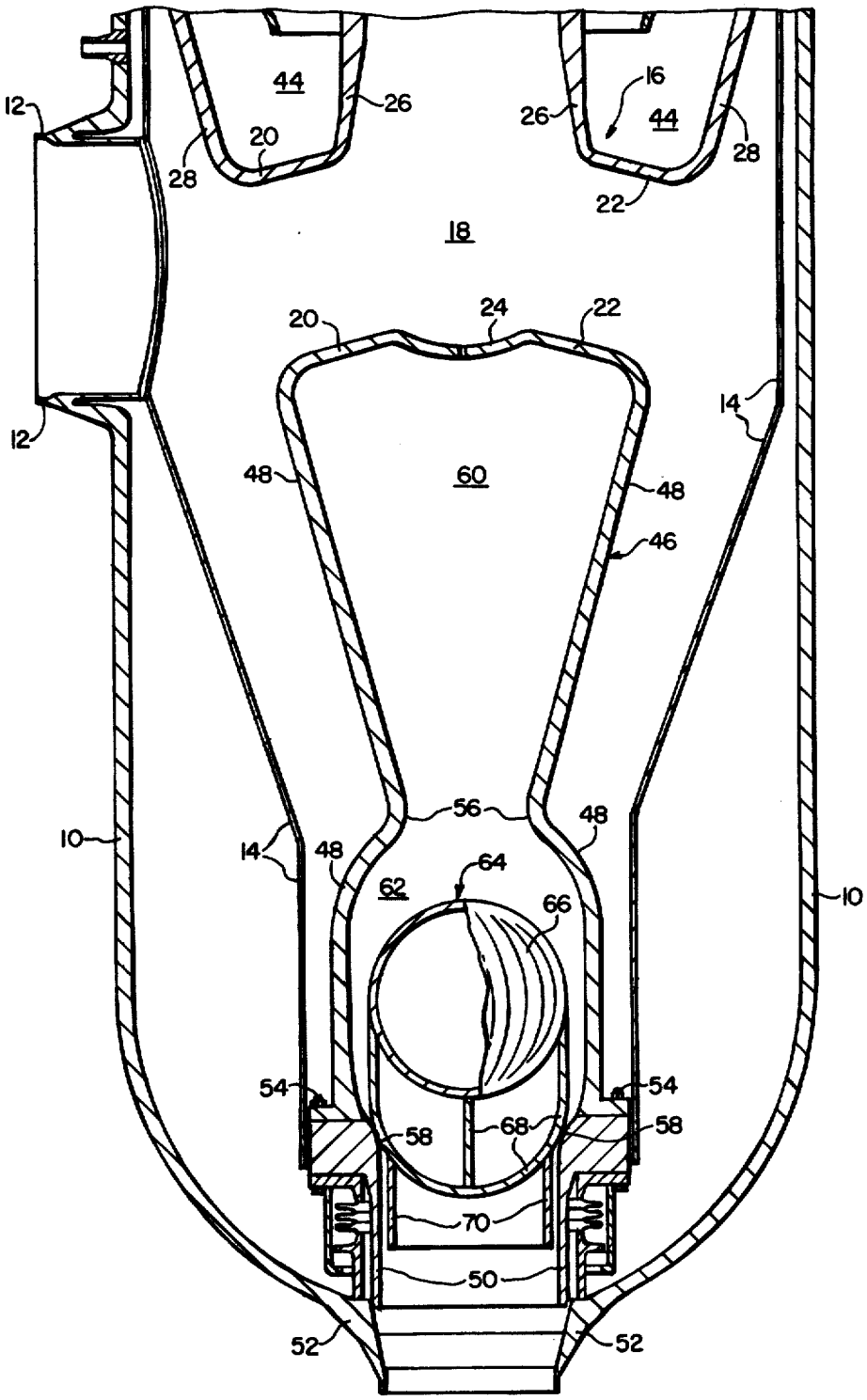
FIG. 2 is a cross-sectional view in elevation of the lower portion of a vertical pump with bottom discharge.

Referring now to FIG. 2, an outlet chamber 46 comprising an upper shell 48 and outlet flange 50 is disposed within collector tank 14. Outlet flange 50 at one end abuts shell 10 near outlet nozzle 52 in a manner well understood by those skilled in the art and at the other end is attached to upper shell 48 by bolts 54 thereby supporting upper shell 48. Upper shell 48 extends from its attachment at its upper end to inlet chamber 16 downward to outlet flange 50 forming therein a first valve seat 56 at its smallest cross-sectional area. Likewise, outlet flange 50 forms a second valve seat 58 at its smallest cross-sectional area. Upper shell 48 together with first valve seat 56 and the bottom of inlet chamber 16 define an outlet plenum 60 which is in fluid communication with diffuser plenum 44 and serves to collect the coolant leaving diffuser plenum 44 for discharge through outlet nozzle 52. In addition, upper shell 48 together with outlet flange 50 define a discharge channel 62 which contains float member 64.

Figure 3:
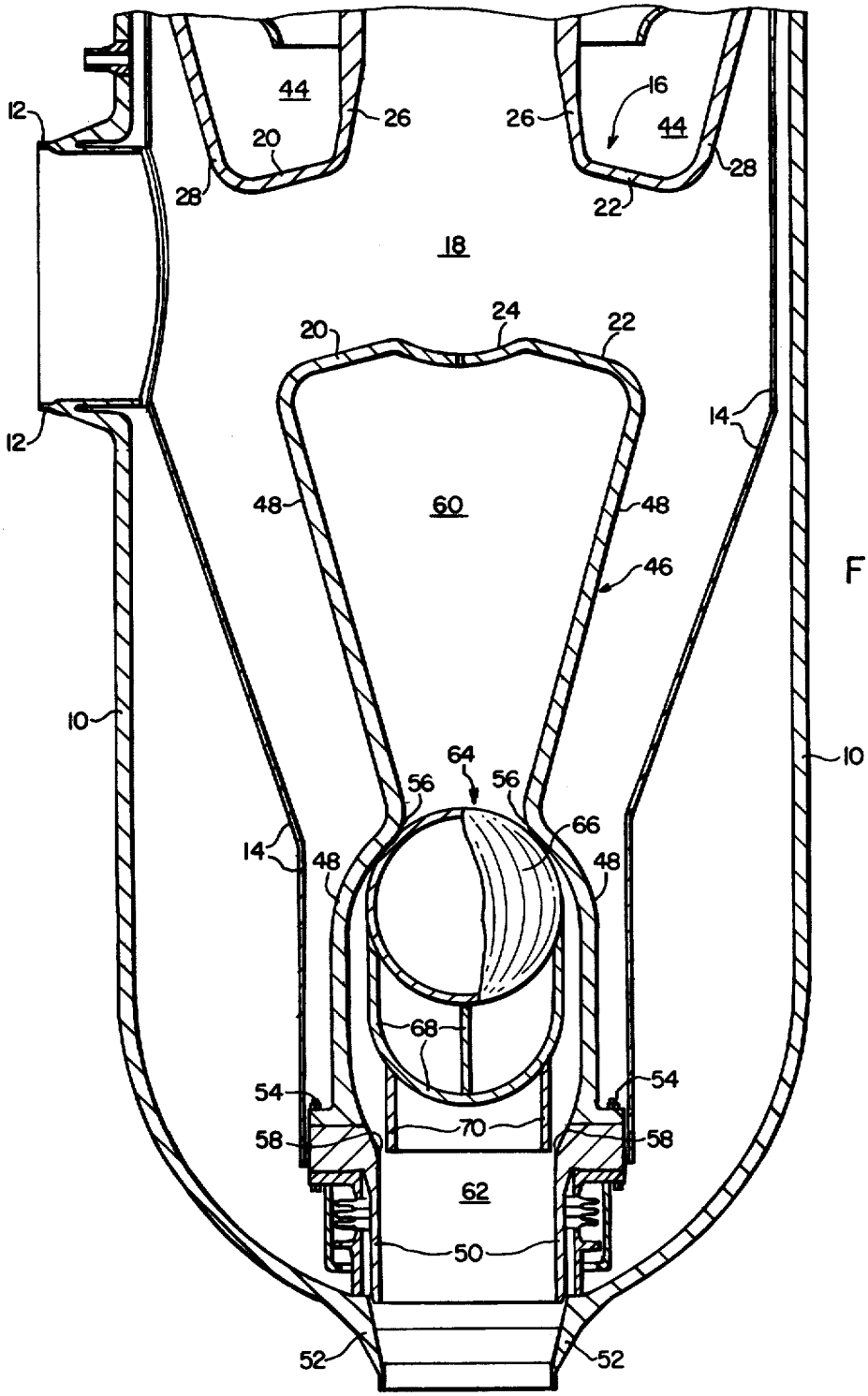
FIG. 3 is a cross-sectional elevation of the lower portion of a vertical pump with bottom discharge showing the float member engaged to block reverse flow.
Figure 4:
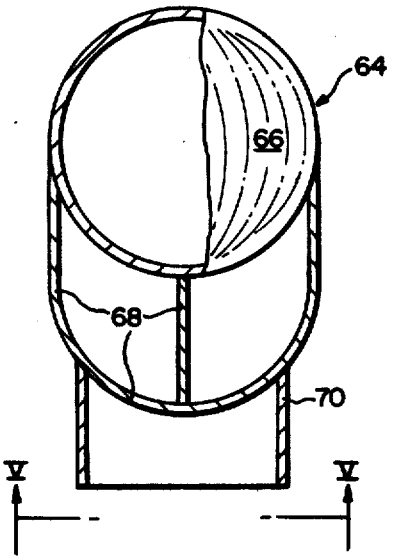
FIG. 4 is a partial cross-sectional view in elevation of the float member.
Figure 5:
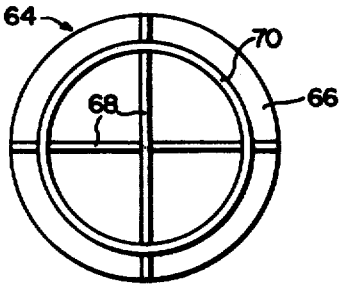
FIG. 5 is a view along the line V—V of FIG. 4.

Again referring to FIG. 2, float member 64 comprises a spherical member 66 and a cage-like member 68. Spherical member 66 may be a hollow stainless steel ball which is attached to stainless steel hemispherical cage-like member 68 by commonly known methods such as welding. Cage-like member 68 may be formed from strips of stainless steel welded at the ends thereof to spherical member 66. The combined weights of spherical member 66 and cage-like member 68 are chosen such that float member 68 will rise up to and engage first valve seat 56 when there is sufficient reverse flow through outlet nozzle 52 (as shown in FIG. 3) but will otherwise rest on second valve seat 58. Cage-like member 68 is constructed so as to allow coolant to flow around spherical member 66, through cage-like member 68, and out outlet nozzle 52 when float member 64 is seated on second valve seat 58. Furthermore, cage-like member 68 has guide member 70 which may be a substantially cylindrical piece of stainless steel attached near the bottom of cage-like member 68 to maintain alignment between float member 64 and outlet flange 50 during movement of float member 64 and to prevent excessive wear of the valve seats during pump operation.

OPERATION

During normal reactor operation, the coolant pump is used to circulate a coolant such as liquid sodium through the primary loop of the reactor system. The coolant enters the coolant pump from the piping network through inlet nozzle 12 and is collected in collector tank 14. From collector tank 14, the coolant enters inlet plenum 18 through either first inlet pipe section 20 or through second inlet pipe section 22. The coolant then is conducted from inlet plenum 18 into diffuser 42 by the action of impeller 32 and vane 34 as they rotate on rotor 36 of motor 38 in a commonly understood fashion. From diffuser 42, the coolant is conducted through diffuser plenum 44 around the outside of first inlet pipe section 20 and second inlet pipe section 22 into outlet plenum 60. Outlet plenum 60 being in fluid communication with discharge channel 62 directs the coolant into discharge channel 62, around spherical member 66, through cage-like member 68, and out outlet nozzle 52. The force of the coolant entering discharge channel 62 through first valve seat 56 causes cage-like member 68 to rest on second valve seat 58 while guide member 70 holds float member 64 in substantial alignment with first valve seat 56 as shown in FIG. 2.

In the event that one of the coolant pumps should fail to operate while the other coolant pumps in the other primary loops continue to operate, the operating coolant pumps will cause the coolant to flow in a reverse path in the non-operating coolant pump. The reverse flow of coolant enters outlet nozzle 52 and flows into discharge channel 62 where the coolant impacts the underside of spherical member 66 and causes a pressure difference across float member 64 whereby the float member 64 rises and engages first valve seat 56 (as shown in FIG. 3). When spherical member 66 is engaged with first valve seat 56, the reverse flow of coolant is prevented from flowing past first valve seat 56 thus stopping the flow of coolant thereby preventing damage to the coolant pump which might have occurred due to reverse rotation of the impeller 32. Guide member 70 slides along the inside of outlet flange 50 during the ascent of float member 64 so as to maintain a vertical alignment of float member 64 such that when the reverse flow ceases cage-like member 68 will again come to rest on second valve seat 58 under the action of either gravity or forward flow through the coolant pump. The weight of float member 64 is chosen such that it will lift when the reverse flow develops a sufficient pressure difference across float member 64. This reverse flow would be less than the flow which would cause free wheeling of the pump. However, the weight of float member 64 is also chosen such that should all coolant pumps fail to operate and a reverse natural circulatory flow be established, float member 64 will not rise and thus allow such a forward or reverse natural circulation of coolant through the primary loop. Of course, the exact weight and dimensions of float member 64 will depend on the design and flow characteristics of the particular pump. For example, when the outside diameter of spherical member 66 is 35 inches and when it is manufactured from 304 stainless steel with a wall thickness of approximately 0.7 inch, that member 64 may weigh approximately 880 pounds. In this example, a reverse flow at a temperature of 110° F. causing a pressure difference of approximately 0.1 psi across float member 64 would cause float member 64 to rise. Normally, such a natural circulation of coolant is a weak flow of coolant which is of insufficient force to cause damage to the coolant pump caused by differences in temperatures through the primary loop. The capability of allowing such a natural circulation is a safety feature that allows cooling of the reactor vessel core even though the coolant pumps are not operating. In addition to this safety feature, the invention also provides the capability of being easily drained of coolant because there are no areas where coolant can accumulate. Furthermore, there are no hinged members that would wear and need to be replaced often.

It can, therefore, be seen that the invention provides a nuclear reactor coolant pump with the capability of preventing reverse flow of a coolant therethrough when such a flow would be of sufficient strength to damage the pump while allowing a natural circulatory flow of coolant, either forward or reverse, when such a natural flow is not of a sufficient strength to cause damage. Moreover, the invention provides the pump with a capability of being easily drainable and yet devoid of hinged members.

While there is described what is now considered to be the preferred embodiment of the invention, it is, of course understood that various other modifications and variations will occur to those skilled in the art. The claims, therefore, are intended to include all such modifications and variations which fall within the true spirit and scope of the present invention.

I claim:

1. A vertical pump with bottom discharge having a free floating check valve comprising:

a substantially vertical discharge channel disposed adjacent to the outlet nozzle of said pump;

a first valve seat formed in the inlet to said discharge channel;

a second valve seat formed in the outlet of said discharge channel and disposed near said outlet nozzle;

a substantially spherical valve member disposed within said discharge channel for engaging said first valve seat under conditions of a reverse flow of coolant through said discharge channel thereby preventing reverse flow through said pump; and a cage-like member with openings therein for the passage of said coolant attached to the underside of said spherical valve member for supporting said spherical valve member and holding said spherical valve member off said second valve seat to thereby allow said coolant to pass through said cage-like member and through said outlet nozzle, said spherical valve member together with said cage-like member acting to prevent reverse flow through said discharge channel that might damage said pump while allowing reverse and forward flows therethrough under conditions that will not damage said pump.

2. The pump recited in claim 1 wherein said pump further comprises:

a guide member attached to the underside of said cage-like member and extending through said second valve seat for guiding said cage-like member and for maintaining alignment of said spherical valve member with said first valve seat while maintaining said cage-like member in alignment with said second valve seat.

3. The pump recited in claim 2 wherein said spherical valve member is a hollow stainless steel ball.

* * * * *